US011565307B2

(12) United States Patent
Okamoto et al.

(10) Patent No.: US 11,565,307 B2
(45) Date of Patent: Jan. 31, 2023

(54) SHAFT DIAMETER ENLARGEMENT CONDITION SETTING METHOD, SHAFT DIAMETER ENLARGEMENT METHOD AND SHAFT DIAMETER ENLARGEMENT APPARATUS

(71) Applicant: NETUREN CO., LTD., Tokyo (JP)

(72) Inventors: Mitsuhiro Okamoto, Tokyo (JP); Fumiaki Ikuta, Tokyo (JP); Yoshitaka Kuwahara, Tokyo (JP); Kazuki Mori, Tokyo (JP); Takashi Ikeda, Tokyo (JP)

(73) Assignee: NETUREN CO., LTD., Tokyo (JP)

( * ) Notice: Subject to any disclaimer, the term of this patent is extended or adjusted under 35 U.S.C. 154(b) by 208 days.

(21) Appl. No.: 16/753,069

(22) PCT Filed: Oct. 31, 2018

(86) PCT No.: PCT/JP2018/040459
§ 371 (c)(1),
(2) Date: Apr. 2, 2020

(87) PCT Pub. No.: WO2019/088153
PCT Pub. Date: May 9, 2019

(65) Prior Publication Data

US 2020/0290114 A1 Sep. 17, 2020

(30) Foreign Application Priority Data

Nov. 1, 2017 (JP) ..... JP2017-212187

(51) Int. Cl.
*B21K 1/12* (2006.01)

(52) U.S. Cl.
CPC ..... *B21K 1/12* (2013.01)

(58) Field of Classification Search
CPC ..... B21J 5/08; B21J 7/16; B21J 9/06
(Continued)

(56) References Cited

U.S. PATENT DOCUMENTS

2018/0245189 A1* 8/2018 Makino ..... C21D 6/002

FOREIGN PATENT DOCUMENTS

JP 2008-212936 9/2008
JP 2008-212937 9/2008
(Continued)

OTHER PUBLICATIONS

International Search Report and Written Opinion of the International Searching Authority, dated Feb. 11, 2019 in corresponding International Patent Application No. PCT/JP2018/040459.

*Primary Examiner* — Jessica Cahill
*Assistant Examiner* — Jared O Brown
(74) *Attorney, Agent, or Firm* — Wenderoth, Lind & Ponack, L.L.P.

(57) ABSTRACT

A method for setting conditions for a shaft diameter enlargement, a shaft diameter enlargement method, and a shaft diameter enlargement apparatus are provided. A controller of the shaft diameter enlargement apparatus controls a compressing section, a bending section, and a rotating section to enlarge an intermediate portion of a shaft workpiece to have a predetermined outer diameter by rotating the shaft workpiece about its axis with axial compressive force a bending angle being applied to the intermediate portion. The controller determines whether the shaft workpiece is acceptable, based on the number of rotations of die shaft workpiece required for enlarging the intermediate portion to have the predetermined outer diameter or based on an enlargement ratio of the intermediate portion.

8 Claims, 7 Drawing Sheets

(58) Field of Classification Search
USPC ..... 72/263
See application file for complete search history.

(56) References Cited

FOREIGN PATENT DOCUMENTS

| | | | | | |
|---|---|---|---|---|---|
| JP | 2016-55292 | | 4/2016 | | |
| JP | 2016055292 | A * | 4/2016 | ..... | B21J 5/08 |
| WO | 2016/079997 | | 5/2016 | | |
| WO | WO-2016079997 | A1 * | 5/2016 | ..... | B21J 5/08 |

* cited by examiner

[Fig. 1]
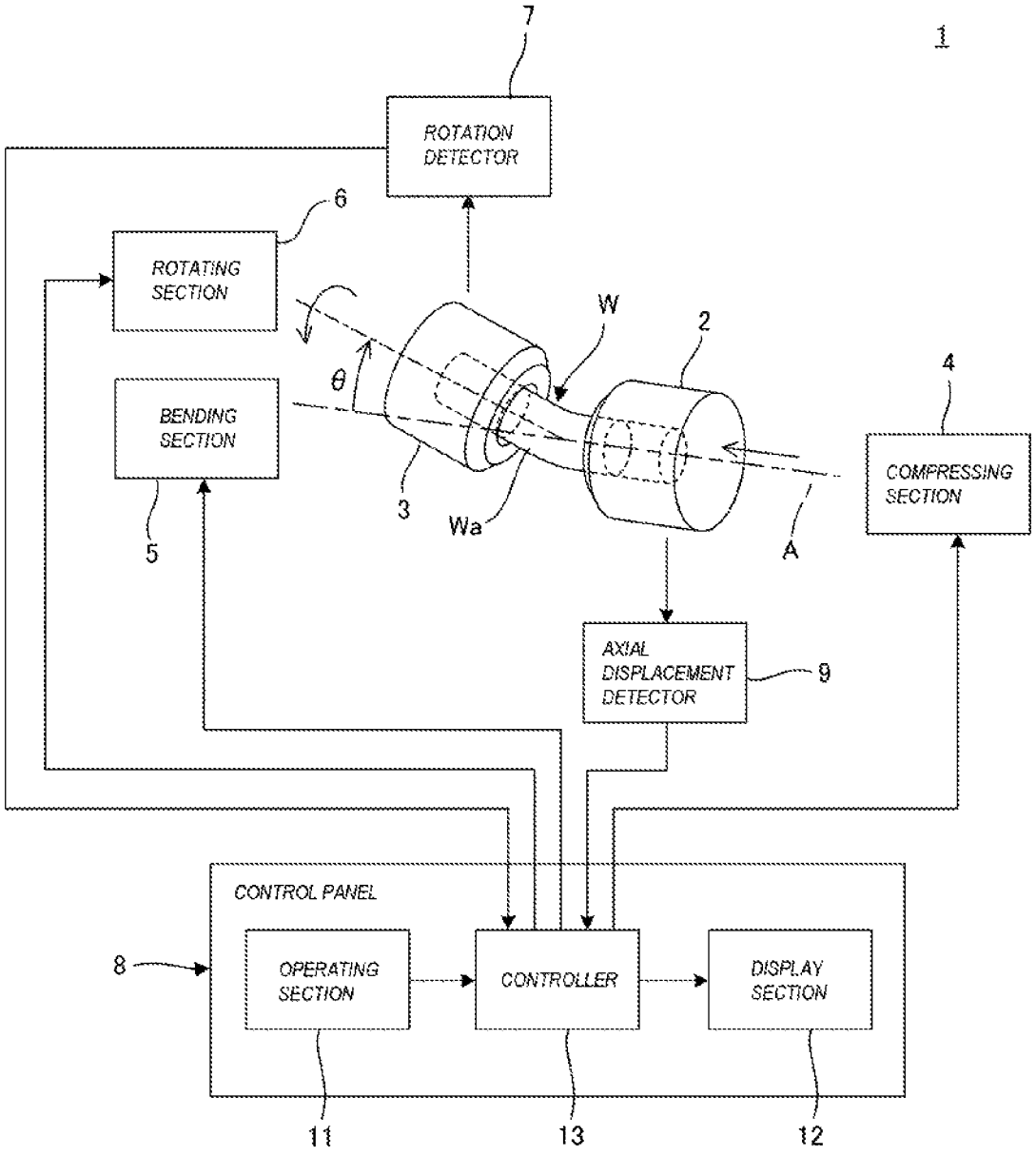

[Fig. 2]
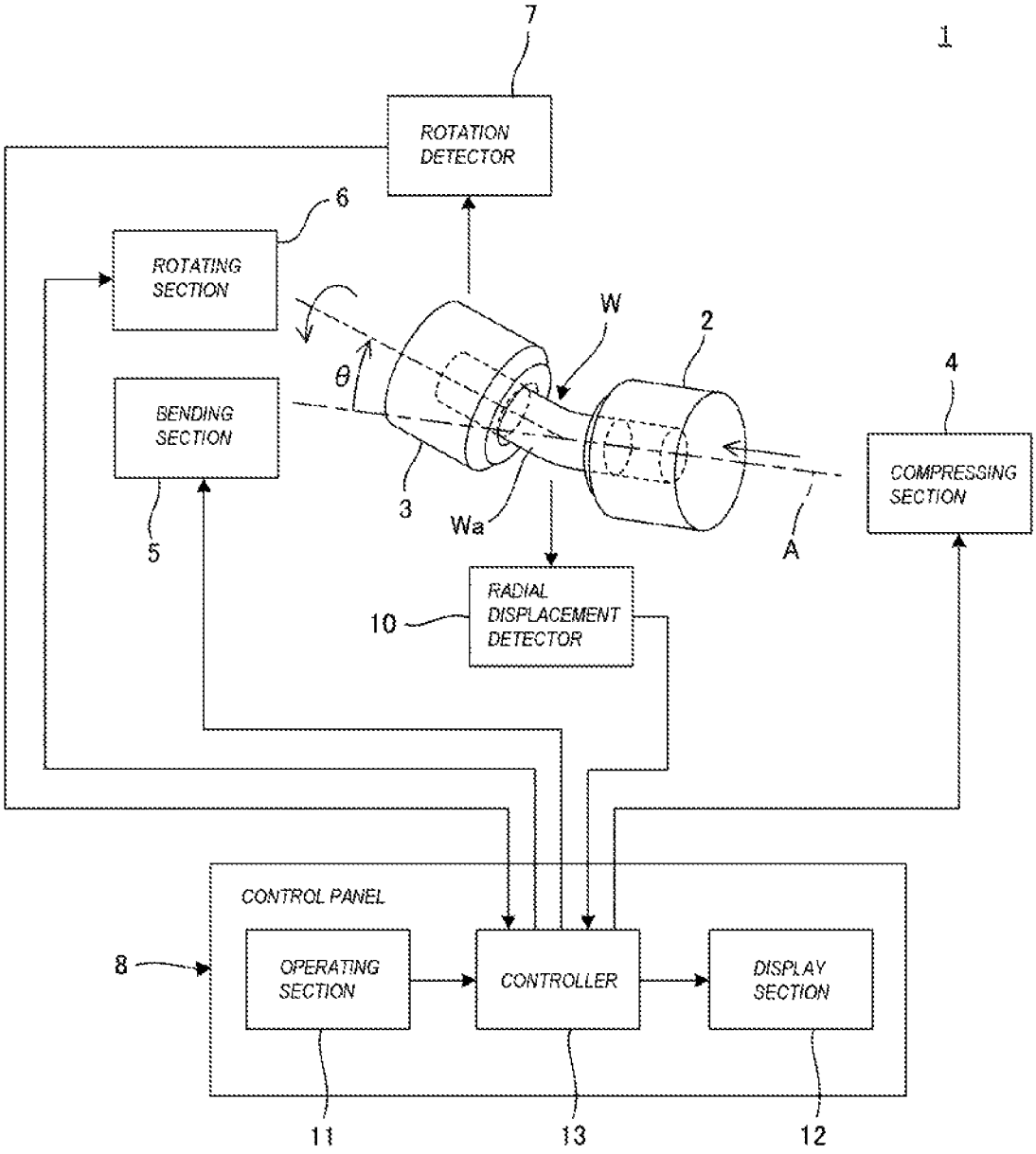
[Fig. 3A]
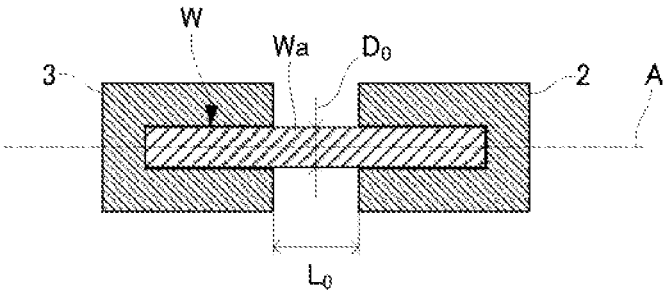

[Fig. 3B]
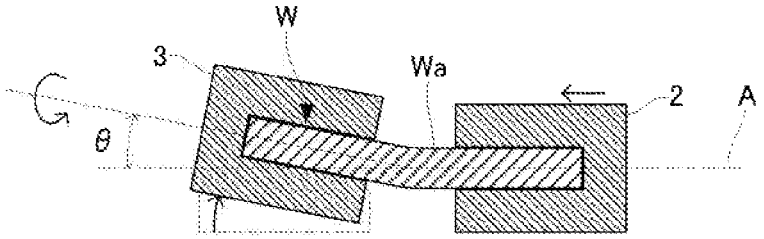
[Fig. 3C]
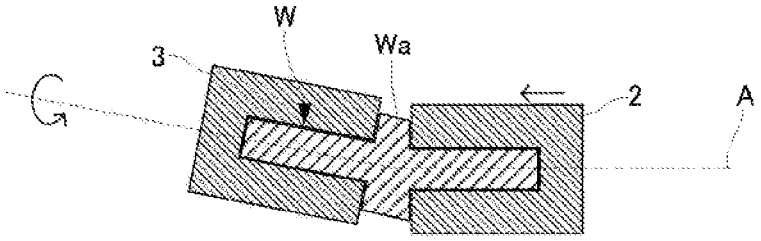
[Fig. 3D]
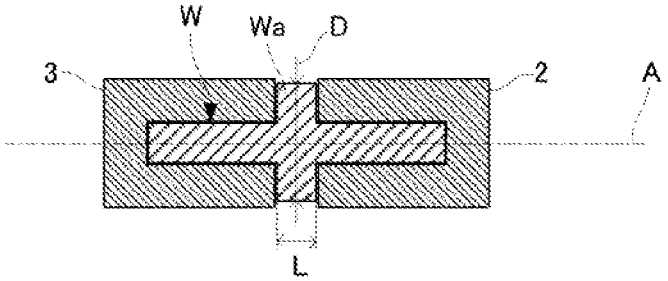

[Fig. 4A]
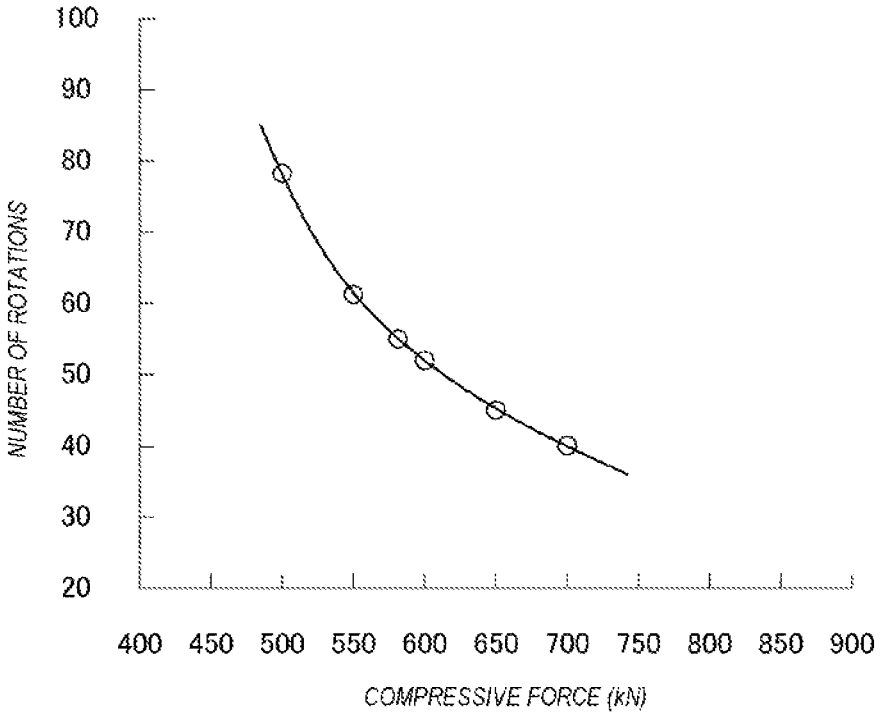
[Fig. 4B]
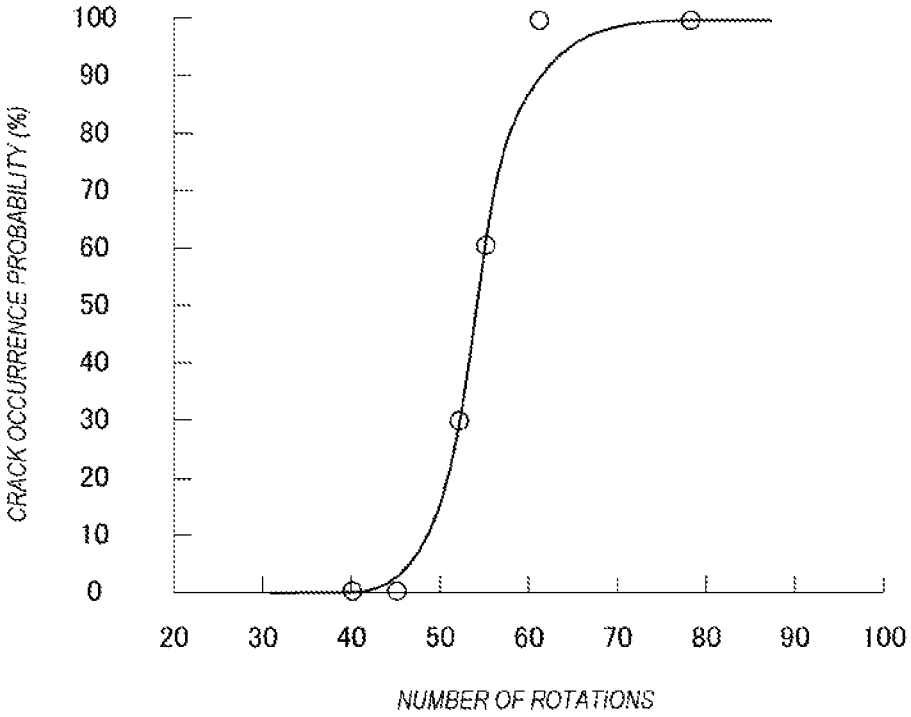

[Fig. 5A]
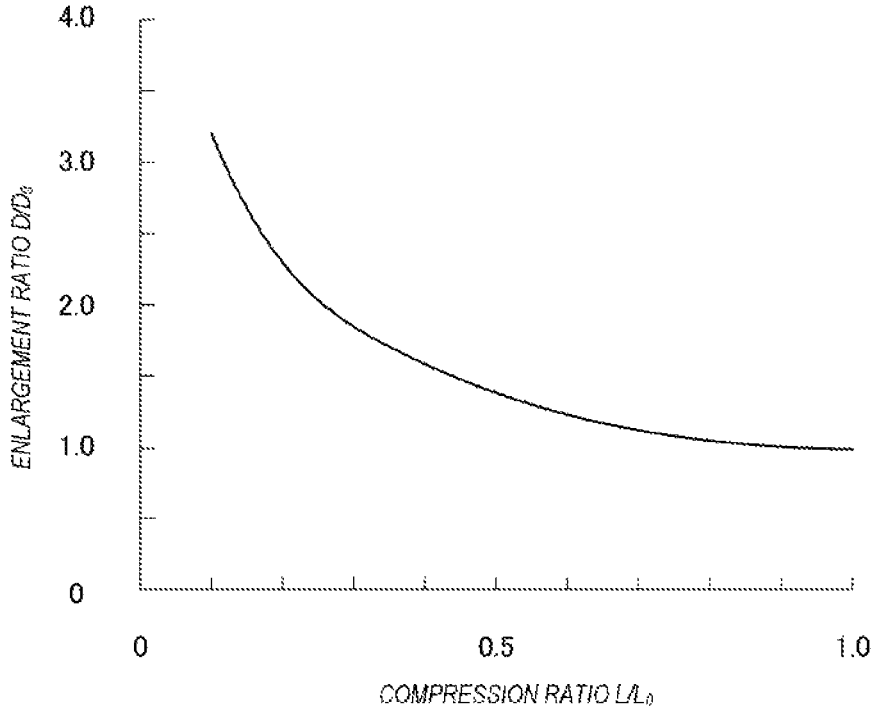
[Fig. 5B]
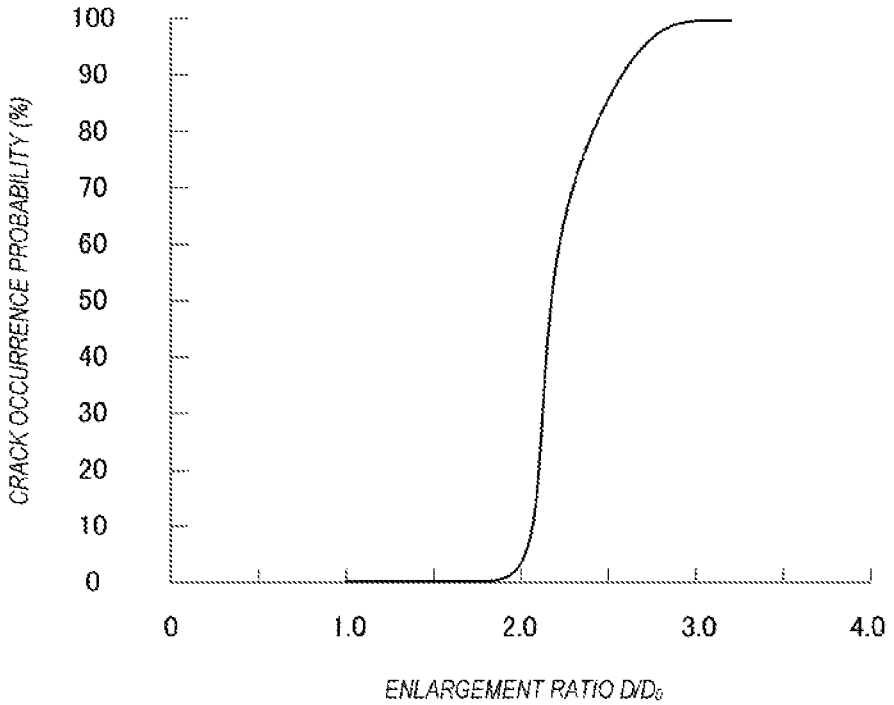

[Fig. 6]
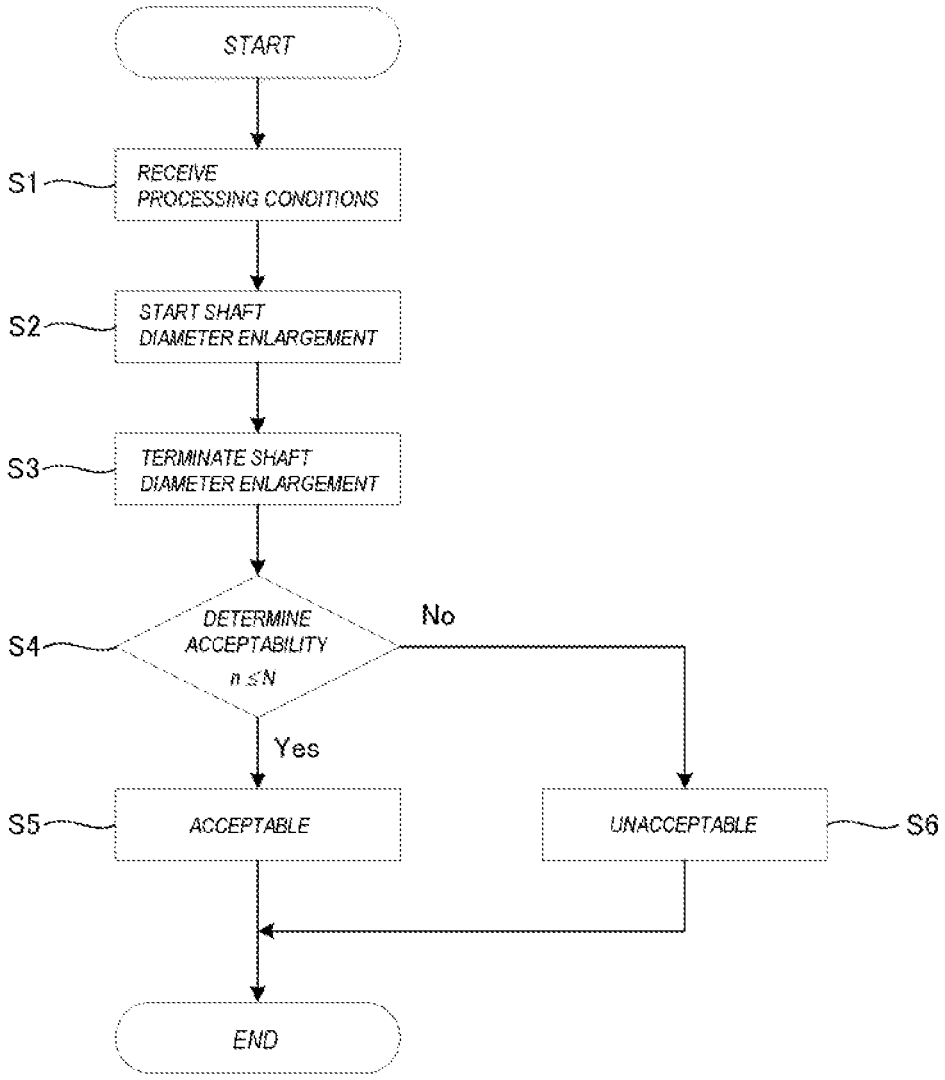

[Fig. 7]
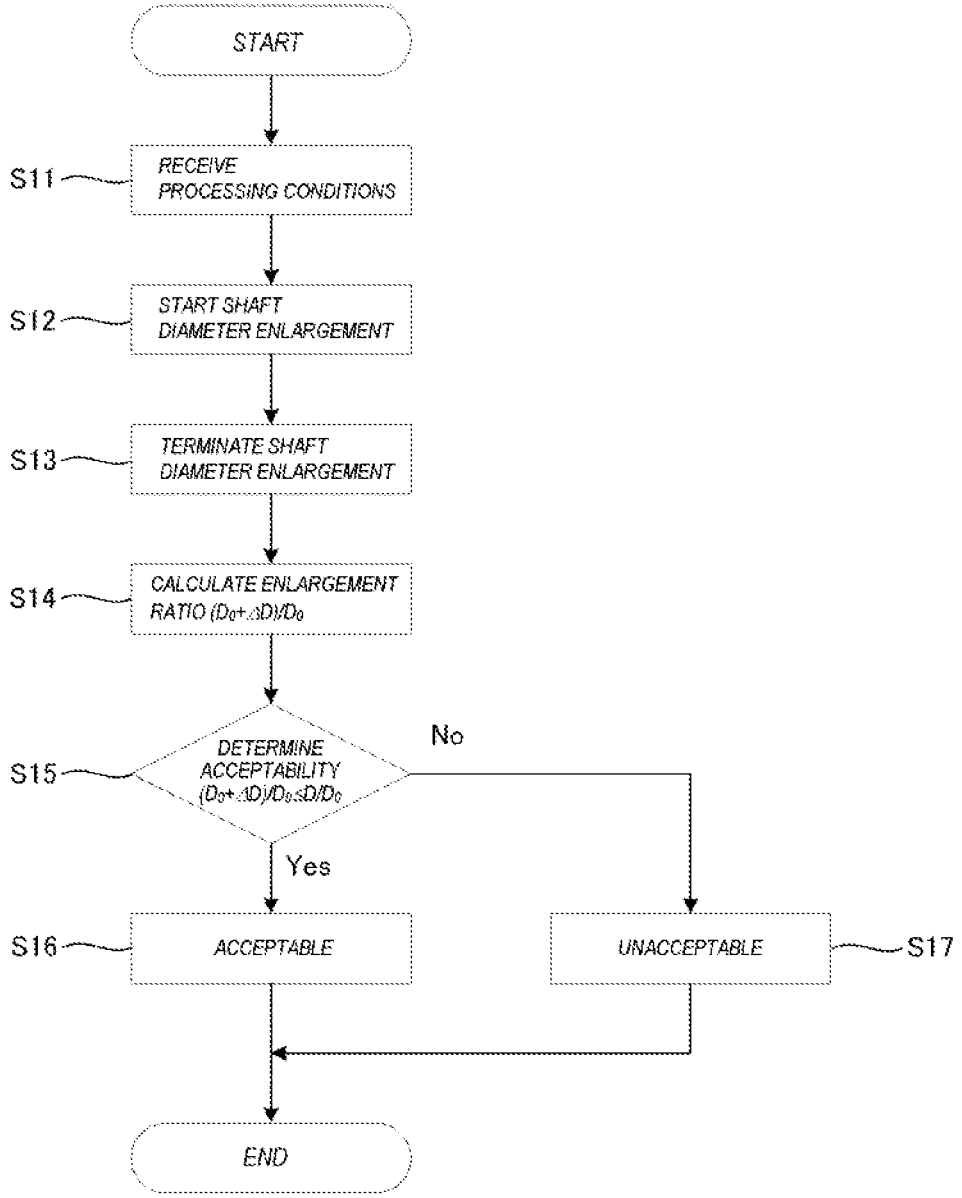

SHAFT DIAMETER ENLARGEMENT CONDITION SETTING METHOD, SHAFT DIAMETER ENLARGEMENT METHOD AND SHAFT DIAMETER ENLARGEMENT APPARATUS

TECHNICAL FIELD

The present invention relates to a method for setting conditions for a shaft diameter enlargement, and a method and an apparatus for the shaft diameter enlargement.

BACKGROUND ART

A shaft diameter enlargement is a method for forming a large diameter portion on a portion of a shaft workpiece. With the shaft diameter enlargement method, for example, an intermediate portion of a shaft workpiece is enlarged by rotating the shaft workpiece while applying a compressive force and a bending angle to the intermediate portion of the shaft workpiece.

In general, in a shaft diameter enlargement apparatus used in the shaft diameter enlargement, a shaft workpiece is held by a pair of holders disposed at a distance from each other in an axial direction of the shaft workpiece, the distance between the pair of holders is reduced to apply a compressive force to an intermediate portion of the shaft workpiece, one of the holders is inclined against the other of the holders to apply a bending angle to the intermediate portion, and in this state, the pair of holders are rotated to rotate the shaft workpiece, and thus, the intermediate portion of the shaft workpiece is enlarged. The process for enlarging the intermediate portion of the shaft workpiece is ended when the distance between the pair of holders is reduced to a prescribed distance (see, for example, JP2008-212937A), or when an outer diameter of the intermediate portion reaches a predetermined outer diameter (see, for example, JP2008-212936A).

The shaft diameter enlargement can sometimes cause a crack at a boundary between the enlarged intermediate portion and a shaft portion other than the intermediate portion or at an outer periphery of the enlarged intermediate portion. A crack can be detected by, for example, visual inspection, magnetic particle inspection, eddy current inspection or the like, but it requires time and cost to check all mass-produced shaft products.

SUMMARY

Illustrative aspects of the present invention provide a method for setting conditions for a shaft diameter enlargement, a shaft diameter enlargement method and a shaft diameter enlargement apparatus m which time and cost necessary for checking presence of a crack can be reduced.

According to an illustrative aspect of the present invention, a method for setting conditions for a shaft diameter enlargement is provided. In the shaft diameter enlargement, an axially intermediate portion of a shaft workpiece is enlarged in a radial direction by rotating the shaft workpiece about an axis of the shaft workpiece with axial compressive force being applied to the intermediate portion and with a bending angle being applied to the intermediate portion. The method includes setting an allowable number of rotations based on test data. The test data is obtained by performing the shaft diameter enlargement on test shafts, each of the test shafts being made of a same material and having a same shape as the shaft workpiece. The test data is indicative of a relationship between, for each of the test shafts, a number of rotations of the test shaft required for enlarging an axially intermediate portion of the test shaft to a predetermined outer diameter and a crack occurrence probability at a boundary between the intermediate portion of the test shaft and a shaft portion of the test shaft other than the intermediate portion. The allowable number of rotations is set such that the crack occurrence probability at the boundary is equal to or lower than a threshold value. The method further includes setting a number of rotations to be performed during the shaft diameter enlargement to enlarge the intermediate portion of the shaft workpiece to the predetermined outer diameter, the set number of rotations being equal to or less than the allowable number of rotations.

According to another illustrative aspect of the present invention, another method for setting conditions for the shaft diameter enlargement is provided. The method includes setting an allowable enlargement ratio based on test data. The test data is obtained by performing the shaft diameter enlargement on test shafts, each of the test shafts having a same material and a same shape as the shaft workpiece. The test data is indicative of a relationship between, for each of the test shafts, an enlargement ratio and a crack occurrence probability at an outer periphery of an axially intermediate portion of the test shaft, the enlargement ratio being a ratio of an outer diameter of the intermediate portion of the test shaft after the shaft diameter enlargement to an outer diameter of the test shaft before the shaft diameter enlargement. The allowable enlargement ratio is set such that the crack occurrence probability at the outer periphery is equal to or lower than a threshold value. The method further includes setting an enlargement ratio to be obtained by the shaft diameter enlargement to enlarge intermediate portion of the shaft workpiece to have a predetermined outer diameter, the set enlargement ratio being equal to or smaller than the allowable enlargement ratio.

According to another illustrative aspect of the present invention, a shaft diameter enlargement method for enlarging an axially intermediate portion a shaft workpiece in a radial direction is provided. The shaft diameter enlargement method includes rotating the shaft workpiece about an axis of the shaft workpiece with axial compressive force being applied to the intermediate portion and with a bending angle being applied to the intermediate portion, and determining whether the shaft workpiece is acceptable based on a number of rotations of the shaft workpiece required for enlarging the intermediate portion of the shaft workpiece to have a predetermined outer diameter.

According to another illustrative aspect of the present invention, another shaft diameter enlargement method for enlarging an axially intermediate portion a shaft workpiece in a radial direction is provided. The shaft diameter enlargement method includes rotating the shaft workpiece about an axis of the shaft workpiece with an axial compressive force being applied to the intermediate portion and with a bending angle applied to the intermediate portion, and determining whether the shaft workpiece is acceptable based on an enlargement ratio, the enlargement ratio being a ratio of an outer diameter of the intermediate portion of the shaft workpiece after being enlarged to an outer diameter of the intermediate portion after being enlarged.

According to another illustrative aspect of the present invention, a shaft diameter enlargement apparatus includes a pair of holders disposed at a distance from each other in an axial direction of a shaft workpiece and configured to hold the shaft workpiece, a compressing section configured to apply axial compressive force to an intermediate portion of the shaft workpiece disposed between the pair of holders by reducing the distance between the pair of holders, a bending section configured to apply a bending angle to the intermediate portion of the shaft workpiece by inclining one of the pair of holders with respect to the other holder, a rotating section configured to rotate the pair of holders and the shaft workpiece about an axis of the shaft workpiece, a rotation detector configured to detect a number of rotations of the shaft workpiece, and a controller configured to control the compressing section, the bending section, and the rotating section, so as to enlarge the intermediate portion of the shaft workpiece to have a predetermined outer diameter by rotating the shaft workpiece about the axis of the shaft workpiece with the axial compressive force being applied to the intermediate portion of the shaft workpiece and with the bending angle being applied to the intermediate portion of the shaft workpiece. The controller is configured to determine whether the shaft workpiece is acceptable based on the number of rotations required for enlarging the intermediate portion of the shaft workpiece to have the predetermined outer diameter.

According to another illustrative aspect of the present invention, a shaft diameter enlargement apparatus includes a pair of holders disposed at a distance from each other in an axial direction of a shaft work piece and configured to hold the shaft workpiece, a compressing section configured to apply a axial compressive force to an intermediate portion of the shaft workpiece disposed between the pair of holders by reducing the distance between the pair of holders, a bending section configured to apply a bending angle to the intermediate portion of the shaft workpiece by inclining one of the pair of holders with respect to the other holder, a rotating section configured rotate the pair of holders and the shaft workpiece about an axis of the shaft workpiece, data axial displacement detector configured to detect an amount of change in the distance between the pair of holders, a radial displacement detector configured to detect an amount of change in an outer diameter of the intermediate portion of the shaft workpiece, and a controller configured to control the compressing section, the bending section, and the rotating section, so as to enlarge the intermediate portion of the shaft workpiece by rotating the shaft workpiece about the axis of the shaft workpiece and reducing, by a predetermined amount, the distance between the pair of holders with the axial compressive force being applied to the intermediate portion of the shaft workpiece and with the bending angle applied to the intermediate portion of the shaft workpiece. The controller is configured to obtain, based on the amount of the change in the outer diameter of the intermediate portion of the shaft workpiece, an enlargement ratio and to determine whether the shaft workpiece is acceptable based on the obtained enlargement ratio, the enlargement ratio being a ratio of the outer diameter of the intermediate portion of the shaft workpiece after being enlarged to the outer diameter before being enlarged.

BRIEF DESCRIPTION OF DRAWINGS

FIG. 1 is a block diagram illustrating an example of a shaft diameter enlargement apparatus according to an embodiment of the present invention.

FIG. 2 is a block diagram illustrating a modification of the shaft diameter enlargement apparatus of FIG. 1.

FIG. 3A is a schematic diagram illustrating an example of a shaft diameter enlargement method using the shaft diameter enlargement apparatus.

FIG. 3B is another schematic diagram illustrating the example of the shaft diameter enlargement method.

FIG. 3C is another schematic diagram illustrating the example of the shaft diameter enlargement method.

FIG. 3D is another schematic diagram illustrating the example of the shaft diameter enlargement method.

FIG. 4A is a graph illustrating an example of test data indicative of a relationship between a compressive force and a number of rotations with test shafts.

FIG. 4B is a graph illustrating an example of test data indicative of a relationship between the number of rotations and a crack occurrence probability with the test shafts.

FIG. 5A is a graph illustrating an example of test data indicative of a relationship between a compression ratio and an enlargement ratio with test shafts.

FIG. 5B is a graph illustrating an example of test data indicative of a relationship between the enlargement ratio and the crack occurrence probability with the test shafts.

FIG. 6 is a flowchart illustrating an example of steps performed by a controller of the shaft diameter enlargement apparatus.

FIG. 7 is a flowchart illustrating another example of steps performed by the controller of the shaft diameter enlargement apparatus.

DESCRIPTION OF EMBODIMENTS

FIG. 1 illustrates an example of a shaft diameter enlargement apparatus to b used for explaining an embodiment of the present invention.

The shaft diameter enlargement apparatus 1 of FIG. 1 includes a pair of holders 2, 3 for holding a shaft workpiece W, a compressing section 4, a bending section 5, a rotating section 6, a rotation detector 7 and a control panel 8.

The holder 2 is configured to be fitted on an axial end of the shaft workpiece W, and the holder 3 is configured to be fitted on the other axial end of the shaft workpiece W, so that the shaft workpiece W can be held by the pair of holders 2, 3. The pair of holders 2, 3 are disposed on a reference line A to be spaced from each other along the reference line A, and are supported by a support table not shown. The shaft workpiece W held by the pair of holders 2, 3 is also disposed on the reference line A. The holder 2 is movable along the reference line A, i.e., movable along the axial direction of the shaft workpiece W, and the other holder 3 is movable along a direction intersecting the reference line A.

The compressing section 4 includes, for example, a fluid pressure cylinder or the like, and moves the holder 2 along the reference line A to reduce a distance between the pair of holders 2, 3. As the distance between the pair of holders 2, 3 is reduced, axial compressive force is applied to an intermediate portion Wa of the shaft workpiece W disposed between the pair of holders 2, 3.

The bending section 5 includes, for example, a fluid pressure cylinder or the like, and moves the holder 3 in the direction crossing the reference line A to incline the holder 3 against the holder 2 disposed on the reference line A. As the holder 3 is inclined against the holder 2, a bending angle θ is applied to the intermediate portion Wa of the shaft workpiece W.

The rotating section 6 includes, for example, an electric motor or the like, and rotates the holder 3 about a central axis of the holder 3. As the holder 3 is rotated, the shaft workpiece W whose one end is fit in the holder 3 is also rotated about its axis, and the holder 2 in which the other end of the shaft workpiece W is fit is also rotated.

The rotation detector 7 includes, for example, a rotary encoder or the like, and is configured to detect the number of rotations of the holder 3 as the number of rotations of the shaft workpiece W. The rotation detector 7 may detect the number of rotations of the holder 2 instead of that of the holder 3, or may detect the number of rotations of the shaft workpiece W.

The control panel 8 has hardware keys such as switches, includes an operating section 11 to be used for inputting processing conditions and the like, and a display device such as a liquid crystal display (LCD), and includes a display section 12 displaying an operatic screen and the like and a controller 13.

The controller 13 is, for example, a computer such as a programmable logic controller (PLC). The controller 13 includes one or more processors, and a memory device such as a read only memory (ROM) or a random access memory (RAM) for storing a program to be executed by the one or more processors and the processing conditions input through the operating section 11. The controller 13 is configured to control, when the one or more processors executes the program, the compressing section 4, the bending section 5 and the rotating section 6.

Under the control of the controller 13, the shaft workpiece W is rotated about its axis by the rotating section 6 with the axial compressive force being applied to the intermediate portion Wa of the shaft workpiece W by the compressing section 4, and with the bending angle θ being applied to the intermediate portion Wa of the shaft workpiece W by the bending section 5. In this manner, the intermediate portion Wa the shaft workpiece W is compressed in the axial direction and enlarged in a radial direction.

The number of rotations detected by the rotation detector 7 is input to the controller 13. The compressing section 4 includes a sensor configured to detect the compressive force. The bending section 5 includes a sensor configured to detect the bending angle θ based on, for example, an amount of displacement of the holder 3. The rotating section 6 includes a sensor configured to detect a rotational speed of the holder 3. The compressive force, the bending angle θ and the rotational speed detected by these sensors are also input to the controller 13. The rotational speed may be calculated by the controller 13 based on the number of rotations detected by the rotation detector 7.

The shaft diameter enlargement apparatus 1 further includes an axial displacement detector 9. The axial displacement detector 9 includes, for example, a linear encoder or the like, and is configured to detect an amount of displacement of the holder 2 moved by the compressing section 4.

The amount of displacement of the holder 2 detected by the axial displacement detector 9 is input to the controller 13. The controller 13 detects an amount of compression of the intermediate portion Wa of the shaft workpiece W an amount of reduction of the length along the axial direction of the intermediate portion Wa) based on the amount of displacement of the holder 2 caused after starting increase of the compressive force, and detects, based on the amount of compression, that the intermediate portion Wa has been enlarged to a predetermined outer diameter.

The shaft diameter enlargement apparatus 1 may include a radial displacement detector 10 configured to detect an amount of change in the outer diameter of the intermediate portion Wa of the shaft workpiece. W as illustrated in FIG. 2, so that the controller 13 may detect that the intermediate portion Wa has been enlarged to the predetermined outer diameter based on the amount of change, from the outer diameter before the enlargement, in the outer diameter of the intermediate portion Wa detected by the radial displacement detector 10.

Now, an example of a shaft diameter enlargement method using the shaft diameter enlargement apparatus 1 will be described with reference to FIGS. 3A to 3E.

First, as illustrated in FIG. 3A, the shaft workpiece W is held by the pair of holders 2, 3. An axial length L of the intermediate portion Wa of the shaft workpiece W before the enlargement is appropriately determined, in relation to an outer diameter $D_0$ of the intermediate portion Wa before the enlargement, in accordance with an axial length L and an outer diameter D of the intermediate portion Wa after the enlargement. Hereinafter, $L/L_0$ is referred to as the compression ratio, and $D/D_0$ is referred to as the enlargement ratio.

Next, as illustrated in FIG. 3B, the holder 2 is moved by the compressing section 4 (see FIG. 1) along the reference line A, and thus, axial compressive force is applied to the intermediate portion Wa of the shaft workpiece W. In addition, the holder 3 is inclined by the bending section 5 (see FIG. 1) with respect to the holder 2, and thus, a bending angle θ is applied to the intermediate portion Wa. The bending angle θ is set to an angle at which the bent of the shaft workpiece W can be within deformation of elastic limit of the shaft workpiece W, and is typically about 2° to 4° although varied depending on the elastic limit of a material of the shaft workpiece W. With the compressive force and the bending angle θ thus being applied to the intermediate portion Wa of the shaft workpiece W, the holder 3 is rotated by the rotating section 6 (see FIG. 1), so as to rotate the shaft workpiece W about its axis.

As illustrated in FIG. 3C, in accordance with the compression, bent and rotation of the intermediate portion Wa of the shaft workpiece W, alternate load in the radial direction is applied to each portion in the circumferential direction of the intermediate portion Wa, and when the alternate load is repeatedly applied, the intermediate portion Wa is gradually enlarged in the radial direction. Specifically, through the compression and the bent of the intermediate portion Wa, the material positioned inside of the bent swells out through plastic flow. Then, as the shaft workpiece W is rotated, the swell of the material positioned inside of the bent of the intermediate portion Wa through the plastic flow grows over the whole circumference, and thus, the intermediate portion Wa is gradually enlarged in the radial direction.

As illustrated FIG. 3D, when the controller 13 (see FIG. 1) detects, based on the amount of compression of the intermediate portion Wa of the shaft workpiece W, or based on the amount of change in the outer diameter of the intermediate portion Wa, that the intermediate portion Wa has been enlarged to the predetermined outer diameter, the compression of the intermediate portion Wa is stopped. Then, the holder 3 is disposed again along the reference line A to unbend the intermediate portion Wa of the shaft workpiece W, and thus, the enlarged thickness of the intermediate portion Wa is made uniform over the entire circumference. Through this process, the shaft diameter enlargement of the shaft workpiece W is completed, and the rotation of the shaft workpiece W is stopped.

Occurrence of a crack at a boundary between the intermediate portion Wa of the shaft workpiece W thus subjected to the shaft diameter enlargement and a shaft portion excluding the intermediate portion Wa (a part fit in the holder 2 or 3) is derived from fatigue of the material due to the repeated application of the alternate load, and is in association with the number of rotations of the shaft workpiece W required for enlarging the intermediate portion Wa to the predetermined outer diameter. Therefore, as a processing condition, an allowable number of rotations is set on the number of rotations of the shaft workpiece required for enlarging the intermediate portion Wa to the predetermined outer diameter.

Besides, the occurrence of a crack at an outer periphery of the intermediate portion Wa of the shaft workpiece W subjected to the shaft diameter enlargement is derived from the enlargement of the intermediate portion Wa beyond the limit of malleability of the material, and is in association with the enlargement ratio $D/D_0$ of the intermediate portion Wa. Therefore, as a processing condition, an allowable enlargement ratio is set on the enlargement ratio $D/D_0$ of the intermediate portion Wa.

FIGS. 4A and 4B illustrate examples of test data used for setting the allowable number of rotations.

The test data illustrated in FIGS. 4A and 4B is test data obtained through the shaft diameter enlargement performed on a test shaft of the same material and the same shape as the shaft workpiece W. The test data illustrated in FIG. 4A illustrates a relationship between the compressive force and the number of rotations obtained by changing the number of rotations of the test shaft necessary for enlarging an intermediate portion of the test shaft to a predetermined outer diameter by changing the compressive force applied to the intermediate portion of the test shaft. Besides, the test data illustrated in FIG. 4B illustrates a crack occurrence probability, in relation to the number of rotations corresponding to each compressive force, at a boundary of the test shaft obtained by subjecting a plurality of test shafts to the shaft diameter enlargement with each of set compressive forces.

According to an interpolation curve of the test data of FIG. 4B, the crack occurrence probability at the boundary is 0% when the number of rotations is 40 or less, the crack occurrence probability is increased as the number of rotations is increased beyond 40, and when the number of rotations is 70 or more, the crack occurrence probability is 100%. It can be said that as the number of rotations is increased, the number of times of repeated application of the alternate load is increased, and as the number of times of repeated application of the alternate load is increased, the material becomes fatigued, and hence the crack occurrence probability is increased.

The allowable number of rotations can be set to the number of rotations at which the crack occurrence probability is equal to or lower than a threshold value, and the threshold value of the crack occurrence probability can be set in consideration of yield and the like to, for example, 0%. Therefore, according to the test data of FIG. 4B, the allowable number of rotations can be set to 40, which is the upper limit of the number of rotations at which the crack occurrence probability is 0%, and preferably, can be set to the number of rotations with a margin, set in consideration of variation in material characteristics of the shaft workpiece, from the number of rotations of 40 corresponding to the upper limit at which the crack occurrence probability is 0%, and the allowable number of rotations can be set to, for example, 32 (with a margin of 20%).

When the bending angle θ to be applied to the intermediate portion Wa of the shaft workpiece W is relatively small, the fatigue of the material caused by each application of the alternate load is relatively small, and when the bending angle θ to be applied to the intermediate portion Wa of the shaft workpiece W is relatively large, the fatigue of the material caused by each application of the alternate load is relatively large. In other words, the bending angle θ to be applied to the intermediate portion Wa is also involved in the crack occurrence at the boundary of the shaft workpiece W. Therefore, the test data to be used for setting the allowable number of rotations is preferably test data obtained by subjecting a test shaft of the same material and the same shape as the shaft workpiece W to the shaft diameter enlargement performed at the same bending angle as the shaft workpiece W.

FIGS. 5A and 5B illustrate examples of test data to be used for setting the allowable enlargement ratio.

The test data illustrated in FIGS. 5A and 5B is test data obtained through the shaft diameter enlargement performed on a test shaft of the same material and the same shape as the shaft workpiece W. The test data illustrated in FIG. 5A illustrates a relationship between the compressive ratio $L/L_0$ and the enlargement ratio $D/D_0$ obtained by changing the enlargement ratio $D/D_0$ of an intermediate portion of the test shaft by changing the compression ratio $L/L_0$ of the intermediate portion of the test shaft. Besides, the test data illustrated in FIG. 5B illustrates a crack occurrence probability, in relation to the enlargement ratio, at an outer periphery of the intermediate portion of the test shaft obtained by subjecting a plurality of test shafts to the shaft diameter enlargement at each of set enlargement ratios.

According to an interpolation curve of the test data of FIG. 5B, the crack occurrence probability at the outer periphery is 0% when the enlargement ratio is 1.8 or less, the crack occurrence probability is increased as the enlargement ratio is increased beyond 1.8, and when the enlargement ratio is 3.0 or more, the crack occurrence probability is 100%. It can be said that as the enlargement ratio is increased, a probability of exceeding the malleability limit of the material is increased, and hence the crack occurrence probability is increased.

The allowable enlargement ratio can be set to an enlargement ratio at which the crack occurrence probability is equal to or lower than a threshold value, and the threshold value of the crack occurrence probability can be set in consideration of yield and the like to, for example, 0%. Therefore, according to the test data of FIG. 5B, the allowable enlargement ratio can be set to 1.8, which is the upper limit of the enlargement ratio at which the crack occurrence probability is 0%, and preferably, can be set to an enlargement ratio with a margin, set in consideration of variation in material characteristics of the shaft workpiece, from the enlargement ratio of 40 corresponding to the upper limit at which the crack occurrence probability is 0%, and the allowable enlargement ratio can be set to, for example, 1.6 (with a margin of 10%).

FIG. 6 illustrates an example of steps performed by the controller 13 in the shaft diameter enlargement of the shaft workpiece W.

First, processing conditions are input to the operating section 11, and the controller 13 stores the input processing conditions (step S1). The input processing conditions include the compressive force, the rotational speed, the bending angle θ, an enlargement terminating condition, and the allowable number of rotations N. The compressive force and the rotational speed can be appropriately set, and for example, from the viewpoint of shortening a cycle time, can be set to the maximum values that can be output by the compressing section 4 and the rotating section 6.

The enlargement terminating condition is a condition for detecting that the intermediate portion Wa of the shaft workpiece W has been enlarged to the predetermined outer diameter, and when the shaft diameter enlargement apparatus 1 includes the axial displacement detector 9 configured to detect the amount of displacement of the holder 2, the amount of displacement of the holder 2 (the amount of compression of the intermediate portion Wa) caused after start of increase of the compressive force is set. Alternatively, when the shaft diameter enlargement apparatus 1 includes the radial displacement detector 10 configured to detect the amount of change in the outer diameter of the intermediate portion Wa, the amount of change in the outer diameter from the outer diameter of the intermediate portion Wa before the enlargement is set.

The amount of displacement of the holder 2 or the amount of change in the outer diameter of the intermediate portion Wa is set in relation to the allowable enlargement ratio. First, a shaft workpiece W in which an enlargement ratio $D/D_0$, $D_0$ being an outer diameter $D_0$ of an intermediate portion Wa before the enlargement and D being an outer diameter of the intermediate portion Wa required after the enlargement, is equal to or smaller than the allowable enlargement ratio is selected, from a plurality of shaft workpieces having different outer diameters $D_0$, in accordance with the outer diameter D required after the enlargement. The amount of change in the outer diameter of the intermediate portion Wa corresponds to a difference between the outer diameter $D_0$ of the intermediate portion Wa of the selected shaft workpiece. W before the enlargement and the outer diameter D required after the enlargement. The volume of the intermediate portion Wa does not change through the shaft diameter enlargement. An axial length L of the intermediate portion Wa after the enlargement is obtained based on an axial length $L_0$ of the intermediate portion Wa before the enlargement and the enlargement ratio $D/D_0$ which is equal to or smaller than the allowable enlargement ratio. The amount of displacement of the holder 2 corresponds to a difference between the axial length $L_0$ of the intermediate portion Wa before the enlargement and the axial length L after the enlargement.

The allowable number of rotations N corresponds to the allowable number of rotations of the selected shaft workpiece W. The bending angle θ can be set to the same bending angle employed in the shaft diameter enlargement performed, on a test shaft of the same material and the same shape as the selected shaft workpiece W, for obtaining the test data to be used for setting the allowable number of rotations N.

Next, when a processing start instruction is input to the operating section 11, the controller 13 controls the compressing section 4, the bending section 5 and the rotating section 6 in accordance with the processing conditions input in step S1 to perform the shaft diameter enlargement on the shaft workpiece W as illustrated in FIGS. 3A to 3D (step S2). When the amount of displacement of the holder 2 detected by the axial displacement detector 9 or the amount of change in the outer diameter of the intermediate portion Wa detected by the radial displacement detecting part 10 reaches the enlargement terminating condition, the controller 13 terminates the shaft diameter enlargement on the shaft workpiece W (step S3).

Next, the controller 13 obtains the number of rotations of the shaft workpiece W detected by the rotation detector 7, that is, a number of rotations n required for enlarging the intermediate portion Wa to the predetermined outer diameter D, and determines, based on the obtained number of rotations n, whether the shaft workpiece W is acceptable (step S4). In this determination for acceptability, the controller 13 uses the allowable number of rotations N input in step S1, so as to determine the shaft workpiece as acceptable when $n \leq N$ (step S5) and as unacceptable when a $n > N$ (step S6).

A case where the number of rotations a exceeds the allowable number of rotations N is, for example, a case where the shaft workpiece W is specifically hard due to variation in the material characteristics of the shaft workpiece. When $n > N$, a crack is expected to occur at the boundary of the shaft workpiece W at a probability corresponding to the number of rotations n on the interpolation curve of the test data illustrated in FIG. 4B. Therefore, the controller 13 determines that the shaft workpiece unacceptable when $n > N$. The determination result is, for example, displayed in the display section 12 under control of the controller 13 to infirm an operator.

When the acceptability on the crack occurrence at the boundary of the shaft workpiece W is thus determined based on the number of rotations n required for enlarging the intermediate portion Wa of the shaft workpiece W to the predetermined outer diameter D, the determination can be made immediately after completing the shaft diameter enlargement, and the time and cost required for checking the presence of a crack can be reduced.

Furthermore, in this exemplified case, the amount of displacement of the holder 2 or the amount of change in the outer diameter of the intermediate portion Wa used as the enlargement terminating condition is set in relation to the allowable enlargement ratio, and hence the occurrence of a crack at the outer periphery of the shaft workpiece W can be also suppressed. Thus, the time and cost required for checking the presence of a crack can be further reduced.

FIG. 7 illustrates another example of the steps performed by the controller 13 in the shaft diameter enlargement of the shaft workpiece W.

In the example illustrated in FIG. 7, the compressive force, the rotational speed, the bending angle θ, the enlargement terminating condition and the allowable enlargement ratio $D/D_0$ are input as the processing conditions, and the controller 13 determines the acceptability by using the input allowable enlargement ratio $D/D_0$. In this example, the shaft diameter enlargement apparatus 1 includes the axial displacement detector 9 configured to detect the amount of displacement of the holder 2, and the radial displacement detector 10 configured to detect the amount of change in the outer diameter of the intermediate portion Wa of the shaft workpiece W. The enlargement terminating condition is set based on the amount of displacement of the holder 2. The radial displacement detector 10 detects the amount of change in the outer diameter of the intermediate portion Wa at which the shaft diameter enlargement is to be terminated.

First, the processing conditions are input to the operating section 11, and the controller 13 stores the input processing conditions (step S11). Next, when a processing start instruction is input to the operating section 11, the controller 13 controls, in accordance with the processing conditions input in step S11, the compressing section 4, the bending section 5 and the rotating section 6 to perform the shaft diameter enlargement on the shaft workpiece W as illustrated in FIGS. 3A to 3D (step S12). When the amount of displacement of the holder 2 detected by the axial displacement detector 9 reaches the enlargement terminating condition, the controller 13 terminates the shaft diameter enlargement of the shaft workpiece W (step S13).

Next, the controller 13 obtains the amount of change in the outer diameter of the intermediate portion Wa detected by the radial displacement detector 10, and obtains an enlargement ratio of the intermediate portion Wa at which the shaft diameter enlargement is to be terminated (step S14). The enlargement ratio of the intermediate portion Wa can be obtained as $(D_0+\Delta D)/D_0$ using the outer diameter $D_0$ before the enlargement of the intermediate portion Wa and the amount $\Delta D$ of change in the outer diameter of the intermediate portion Wa detected by the radial displacement detector 10.

Then, the controller 13 determines acceptability of the shaft workpiece W based on the enlargement ratio $(D_0\Delta D)/D_0$ obtained in step S14 (step S15). In this determination for acceptability, the controller 13 uses the allowable enlargement ratio $D/D_0$ input in step S11 to determine the shaft workpiece as acceptable when $(D_0+\Delta D)/D_0 \leq D/D_0$ (step S16) and as unacceptable when $(D_0+\Delta D)/D_0 > D/D_0$ (step S17).

A case where the enlargement ratio $(D_0+\Delta D)/D_0$ exceeds the allowable enlargement ratio $D/D_0$ is, for example, a case where the axial length L of the intermediate portion Wa of the shaft workpiece W to be enlarged is specifically large due to dimensional error of the shaft workpiece and hence the amount $\Delta D$ of change in the outer diameter after the enlargement is specifically large. Assuming that the amount of displacement of the holder 2 is constant, as the axial length $L_0$ before the enlargement is larger, the amount $\Delta D$ of change in the outer diameter of the intermediate portion Wa is larger. When $(D_0+\Delta D)/D_0 > D/D_0$, a crack is expected to occur at the outer periphery of the shaft workpiece W at a probability corresponding to the enlargement ratio $(D_0+\Delta D)/D_0$ on the interpolation curve of the test data illustrated in FIG. 5B. Therefore, the controller 13 determines the shaft workpiece as unacceptable when $(D_0+\Delta D)/D_0 > D/D_0$. The determination result is, for example, displayed in the display section 12 under control of the controller 13 to inform an operator.

When the acceptability on the crack occurrence at the outer periphery of the shaft workpiece W is thus determined based on the enlargement ratio of the intermediate portion of the shaft workpiece. W, the determination can be made immediately after completing the shaft diameter enlargement, and the time and cost required for checking the presence of a crack can be reduced.

The determination for the acceptability on the occurrence of a crack at the outer periphery based on the enlargement ratio and the allowable enlargement ratio of the intermediate portion Wa illustrated in FIG. 7 can be performed in combination with the determination for the acceptability on the occurrence of a crack at the boundary based on the number of rotations and the allowable number of rotations of the shaft workpiece W illustrated in FIG. 6.

According to one or more embodiments of the present invention, a method for setting conditions for a shaft diameter enlargement is provided. In the shaft diameter enlargement, an axially intermediate portion of a shaft workpiece is enlarged in a radial direction by rotating the shaft workpiece about an axis of the shaft workpiece with axial compressive force being applied to the intermediate portion and with a bending angle being applied to the intermediate portion. The method includes setting an allowable number of rotations based on test data. The test data is obtained by performing the shaft diameter enlargement on test shafts, each of the test shafts being made of a same material and having a same shape as the shaft workpiece. The test data is indicative of a relationship between, for each of the test shafts, a number of rotations of the test shaft required for enlarging an axially intermediate portion of the test shaft to a predetermined outer diameter and a crack occurrence probability at a boundary between the intermediate portion of the test shaft and a shaft portion of the test shaft other than the intermediate portion. The allowable number of rotations is set such that the crack occurrence probability at the boundary is equal to or lower than a threshold value. The method further includes setting a number of rotations to be performed during the shaft diameter enlargement to enlarge the intermediate portion of the shaft workpiece to the predetermined outer diameter, the set number of rotations being equal to or less than the allowable number of rotations.

According to one or more embodiments of the present invention, another method for setting conditions for the shaft diameter enlargement is provided. The method includes setting an allowable enlargement ratio based on test data. The test data is obtained by performing the shaft diameter enlargement on test shafts, each of the test shafts having a same material and a same shape as the shaft workpiece. The test data is indicative of a relationship between, for each of the test shafts, an enlargement ratio and a crack occurrence probability at an outer periphery of an axially intermediate portion of the test shaft, the enlargement ratio being a ratio of an outer diameter of the intermediate portion of the test shaft after the shaft diameter enlargement to an outer diameter of the test shaft before the shaft diameter enlargement. The allowable enlargement ratio is set such that the crack occurrence probability at the outer periphery is equal to or lower than a threshold value. The method further includes setting an enlargement ratio to be obtained by the shaft diameter enlargement to enlarge the intermediate portion of the shaft workpiece to have a predetermined outer diameter, the set enlargement ratio being equal to or smaller than the allowable enlargement ratio.

According to one or more embodiments of the present invention, the test data may be obtained by performing the shaft diameter enlargement on the test shafts with the same bending angle as in the shaft diameter enlargement to be performed on the shaft workpiece.

According to one or more embodiments of the present invention, a shaft diameter enlargement method for enlarging an axially intermediate portion a shaft workpiece in a radial direction is provided. The shaft diameter enlargement method includes rotating the shaft workpiece about an axis of the shaft workpiece with axial compressive force being applied to the intermediate portion and with a bending angle being applied to the intermediate portion, and determining whether the shaft workpiece is acceptable based on a number of rotations of the shaft workpiece required for enlarging the intermediate portion of the shaft workpiece to have a predetermined outer diameter.

According to one or more embodiments of the present invention, the shaft diameter enlargement method may further include setting an allowable number of rotations based on test data. The test data is obtained by performing a shaft diameter enlargement on test shafts, each of the test shafts being made of a same material and having a same shape as the shaft workpiece. The test data is indicative of a relationship between, for each of the test shafts, a number of rotations of the test shaft required for enlarging an axially intermediate portion of the test shaft to a predetermined outer diameter and a crack occurrence probability at a boundary between the intermediate portion of the test shaft and a shaft portion of the test shaft other than the intermediate portion. The allowable number of rotations is set such that the crack occurrence probability at the boundary is equal to or lower than a threshold value. The shaft workpiece is may be determined as being acceptable when the number of rotations of the shaft workpiece is equal to or less than the allowable number of rotations, and the shaft workpiece is may be determined as being unacceptable when the number of rotations of the shaft workpiece exceeds the allowable number of rotations.

According to one or more embodiments of the present invention, the test data may be obtained by performing the shaft diameter enlargement on the test shafts with the same bending angle as in the shaft diameter enlargement to be performed on the shaft workpiece.

According to one or more embodiments of the present invention, the shaft diameter enlargement method may further include setting an allowable enlargement ratio based on the test data. The test data is obtained by performing the shaft diameter enlargement on the test shafts. The test data is indicative of a relationship between, for each of the test shafts, an enlargement ratio and a crack occurrence probability at an outer periphery of an axially intermediate portion of the test shaft, the enlargement ratio being a ratio of an outer diameter of the intermediate portion of the test shaft after the shaft diameter enlargement to an outer diameter of the test shaft before the shaft diameter enlargement. The allowable enlargement ratio is set such that the crack occurrence probability at the outer periphery is equal to or lower than a threshold value. The shaft diameter enlargement method may further include setting an enlargement ratio to be obtained by the shaft diameter enlargement to enlarge the intermediate portion of the shaft workpiece to have the predetermined outer diameter, the set enlargement ratio being equal to or smaller than the allowable enlargement ratio.

According to one or more embodiments of the present invention, another shaft diameter enlargement method for enlarging an axially intermediate portion a shaft workpiece in a radial direction is provided. The shaft diameter enlargement method includes rotating the shaft workpiece about an axis of the shaft workpiece with an axial compressive force being applied to the intermediate portion and with a bending angle applied to the intermediate portion, and determining whether the shaft workpiece is acceptable based on an enlargement ratio, the enlargement ratio being a ratio of an outer diameter of the intermediate portion of the shaft workpiece after being enlarged to an outer diameter of the intermediate portion after being enlarged.

According to one or more embodiments of the present invention, the shaft diameter enlargement method may further include setting an allowable enlargement ratio based on test data. The test data is obtained by performing a shaft diameter enlargement on test shafts, each of the test shafts having a same material and a same shape as the shaft workpiece. The test data is indicative of a relationship between, for each of the test shafts, an enlargement ratio and a crack occurrence probability at an outer periphery of an axially intermediate portion of the test shaft, the enlargement ratio being a ratio of an outer diameter of the intermediate portion of the test shaft after the shaft diameter enlargement to an outer diameter of the test shaft before the shaft diameter enlargement. The allowable enlargement ratio is set such that the crack occurrence probability at the outer periphery is equal to or lower than a threshold value. The shaft workpiece may be determined as being acceptable when the enlargement ratio of the shaft workpiece is equal to or smaller than the allowable enlargement ratio, and the shaft workpiece may be determined as being unacceptable when the enlargement ratio of the shaft workpiece exceeds the allowable enlargement ratio.

According to one or more embodiments of the present invention, a shaft diameter enlargement apparatus includes a pair of holders disposed at a distance from each other in an axial direction of a shaft workpiece and configured to hold the shaft workpiece, a compressing section configured to apply axial compressive force to an intermediate portion of the shaft workpiece disposed between the pair of holders by reducing the distance between the pair of holders, a bending section configured to apply a bending angle to the intermediate portion of the shaft workpiece by inclining one of the pair of holders with respect to the other holder, a rotating section configured to rotate the pair of holders and the shaft workpiece about an axis of the shaft workpiece, a rotation detector configured to detect a number of rotations of the shaft workpiece, and a controller configured to control the compressing section, the bending section, and the rotating section, so as to enlarge the intermediate portion of the shaft workpiece to have a predetermined outer diameter by rotating the shaft workpiece about the axis of the shaft workpiece with the axial compressive force being applied to the intermediate portion of the shaft workpiece and with the bending angle being applied to the intermediate portion of the shaft workpiece. The controller is configured to determine whether the shaft workpiece is acceptable based on the number of rotations required for enlarging the intermediate portion of the shaft workpiece to have the predetermined outer diameter.

According to one or more embodiments of the present invention, a shaft diameter enlargement apparatus includes a pair of holders disposed at a distance from each other in an axial direction of a shaft workpiece and configured to hold the shaft workpiece, compressing section configured to apply a axial compressive force to an intermediate portion of the shaft workpiece disposed between the pair of holders by, reducing the distance between the pair of holders, a bending section configured to apply a bending angle to the intermediate portion of the shaft workpiece by inclining one of the pair of holders with respect to the other holder, a rotating section configured rotate the pair of holders and the shaft workpiece about an axis of the shaft workpiece, an axial displacement detector configured to detect an amount of change in the distance between the pair of holders, a radial displacement detector configured to detect an amount of change in an outer diameter of the intermediate portion of the shaft workpiece, and a controller configured to control the compressing section, the bending section, and the rotating section, so as to enlarge the intermediate portion of the shaft workpiece by rotating the shaft workpiece about the axis of the shaft workpiece and reducing, by a predetermined amount, the distance between the pair of holders with the axial compressive force being applied to the intermediate portion of the shaft workpiece and with the bending angle applied to the intermediate portion of the shaft workpiece. The controller is configured to obtain, based on the amount of the change in the outer diameter of the intermediate portion of the shaft workpiece, an enlargement ratio and to determine whether the shaft workpiece is acceptable based on the obtained enlargement ratio, the enlargement ratio being a ratio of the outer diameter of the intermediate portion of the shaft workpiece after being enlarged to the outer diameter before being enlarged.

This application claims priority to Japanese Patent Application No. 2017-212187 filed on Nov. 1, 2017, the entire content of which is incorporated herein by reference.

The invention claimed is:

1. A method for setting conditions for a shaft diameter enlargement in which an axially intermediate portion of a shaft workpiece is enlarged in a radial direction by rotating the shaft workpiece about an axis of the shaft workpiece with axial compressive force being applied to the intermediate portion and with a bending angle being applied to the intermediate portion, the method comprising:

setting an allowable number of rotations based on test data, wherein the test data is obtained by performing the shaft diameter enlargement on test shafts, each of the test shafts being made of a same material and having a same shape as the shaft workpiece, wherein the test data is indicative of a relationship between, for each of the test shafts, a number of rotations of the test shaft required for enlarging an axially intermediate portion of the test shaft to a predetermined outer diameter and a crack occurrence probability at a boundary between the intermediate portion of the test shaft and a shaft portion of the test shaft other than the intermediate portion, and wherein the allowable number of rotations is set such that the crack occurrence probability at the boundary is equal to or lower than a threshold value; and setting a number of rotations to be performed during the shaft diameter enlargement to enlarge the intermediate portion of the shaft workpiece to the predetermined outer diameter, the set number of rotations being equal to or less than the allowable number of rotations.

2. The method according to claim 1, wherein the test data is obtained by performing the shaft diameter enlargement on the test shafts with a same bending angle as in the shaft diameter enlargement to be performed on the shaft workpiece.

3. A method for setting conditions for a shaft diameter enlargement in which an axially intermediate portion a shaft workpiece is enlarged in a radial direction by rotating the shaft workpiece about an axis of the shaft workpiece with axial compressive force being applied to the intermediate portion and with a bending angle being applied to the intermediate portion, the method comprising:

setting a maximum allowable enlargement ratio based on test data, wherein the test data is obtained by performing the shaft diameter enlargement on test shafts, each of the test shafts having a same material and a same shape as the shaft workpiece, wherein the test data is indicative of a relationship between, for each of the test shafts, an enlargement ratio and a crack occurrence probability at an outer periphery of an axially intermediate portion of the test shaft, the enlargement ratio being a ratio of an outer diameter of the intermediate portion of the test shaft after the shaft diameter enlargement to an outer diameter of the test shaft before the shaft diameter enlargement, and wherein the maximum allowable enlargement ratio is set such that the crack occurrence probability at the outer periphery is equal to or lower than a threshold value; and setting an enlargement ratio to be obtained by the shaft diameter enlargement to enlarge the intermediate portion of the shaft workpiece to have a predetermined outer diameter, the set enlargement ratio being equal to or smaller than the maximum allowable enlargement ratio.

4. A shaft diameter enlargement method for enlarging an axially intermediate portion a shaft workpiece in a radial direction, the shaft diameter enlargement method comprising:

rotating the shaft workpiece about an axis of the shaft workpiece with axial compressive force being applied to the intermediate portion and with a bending angle being applied to the intermediate portion;

determining whether the shaft workpiece is acceptable with regard to cracking probability based on a number of rotations of the shaft workpiece required for enlarging the intermediate portion of the shaft workpiece to have a predetermined outer diameter; and setting an allowable number of rotations based on test data, wherein the test data is obtained by performing a shaft diameter enlargement on test shafts, each of the test shafts being made of a same material and having a same shape as the shaft workpiece, wherein the test data is indicative of a relationship between, for each of the test shafts, a number of rotations of the test shaft required for enlarging an axially intermediate portion of the test shaft to a predetermined outer diameter and a boundary crack occurrence probability at a boundary between the intermediate portion of the test shaft and a shaft portion of the test shaft other than the intermediate portion, and wherein the allowable number of rotations is set such that the boundary crack occurrence probability at the boundary is equal to or lower than a threshold value, wherein the shaft workpiece is determined as being acceptable when the number of rotations of the shaft workpiece is equal to or less than the allowable number of rotations, and the shaft workpiece is determined as being unacceptable when the number of rotations of the shaft workpiece exceeds the allowable number of rotations.

5. The shaft diameter enlargement method according to claim 4, wherein the test data is obtained by performing the shaft diameter enlargement on the test shafts with a same bending angle as in the shaft diameter enlargement to be performed on the shaft workpiece.

6. The shaft diameter enlargement method according to claim 4, further comprising:

setting a maximum allowable enlargement ratio based on the test data, wherein the test data is also indicative of a relationship between, for each of the test shafts, an enlargement ratio and an outer periphery crack occurrence probability at an outer periphery of the axially intermediate portion of the test shaft, the enlargement ratio being a ratio of an outer diameter of the intermediate portion of the test shaft after the shaft diameter enlargement to an outer diameter of the test shaft before the shaft diameter enlargement, and wherein the maximum allowable enlargement ratio is set such that the outer periphery crack occurrence probability at the outer periphery is equal to or lower than another threshold value; and setting an enlargement ratio to be obtained by the shaft diameter enlargement to enlarge the intermediate portion of the shaft workpiece to have the predetermined outer diameter, the set enlargement ratio being equal to or smaller than the maximum allowable enlargement ratio.

7. A shaft diameter enlargement method for enlarging an axially intermediate portion a shaft workpiece in a radial direction, the shaft diameter enlargement method comprising:

rotating the shaft workpiece about an axis of the shaft workpiece with an axial compressive force being applied to the intermediate portion and with a bending angle being applied to the intermediate portion;

determining whether the shaft workpiece is acceptable with regard to cracking probability based on a shaft workpiece enlargement ratio, the shaft workpiece enlargement ratio being a ratio of an outer diameter of the intermediate portion of the shaft workpiece after being enlarged to an outer diameter of the intermediate portion before being enlarged; and setting a maximum allowable enlargement ratio based on test data, wherein the test data is obtained by performing a shaft diameter enlargement on test shafts, each of the test shafts having a same material and a same shape as the shaft workpiece, wherein the test data is indicative of a relationship between, for each of the test shafts, a test shaft enlargement ratio and an outer periphery crack occurrence probability at an outer periphery of an axially intermediate portion of the test shaft, the test shaft enlargement ratio being a ratio of an outer diameter of the intermediate portion of the test shaft after the shaft diameter enlargement to an outer diameter of the test shaft before the shaft diameter enlargement, and wherein the maximum allowable enlargement ratio is set such that the outer periphery crack occurrence probability at the outer periphery is equal to or lower than a threshold value, wherein the shaft workpiece is determined as being acceptable when the shaft workpiece enlargement ratio of the shaft workpiece is equal to or smaller than the maximum allowable enlargement ratio, and the shaft workpiece is determined as being unacceptable when the shaft workpiece enlargement ratio of the shaft workpiece exceeds the maximum allowable enlargement ratio.

8. The shaft diameter enlargement method according to claim 5, further comprising:

setting a maximum allowable enlargement ratio based on the test data, wherein the test data is also indicative of a relationship between, for each of the test shafts, an enlargement ratio and an outer periphery crack occurrence probability at an outer periphery of the axially intermediate portion of the test shaft, the enlargement ratio being a ratio of an outer diameter of the intermediate portion of the test shaft after the shaft diameter enlargement to an outer diameter of the test shaft before the shaft diameter enlargement, and wherein the maximum allowable enlargement ratio is set such that the outer periphery crack occurrence probability at the outer periphery is equal to or lower than another threshold value; and setting an enlargement ratio to be obtained by the shaft diameter enlargement to enlarge the intermediate portion of the shaft workpiece to have the predetermined outer diameter, the set enlargement ratio being equal to or smaller than the maximum allowable enlargement ratio.

* * * * *